US008516933B2

(12) United States Patent
Swindell

(10) Patent No.: US 8,516,933 B2
(45) Date of Patent: Aug. 27, 2013

(54) INTERNAL COMBUSTION ENGINE IGNITION TIMING TOOL

(76) Inventor: Jeffrey L. Swindell, Bartlett, TN (US)

( * ) Notice: Subject to any disclaimer, the term of this patent is extended or adjusted under 35 U.S.C. 154(b) by 0 days.

(21) Appl. No.: 13/574,778

(22) PCT Filed: Jan. 19, 2011

(86) PCT No.: PCT/US2011/021728

§ 371 (c)(1),
(2), (4) Date: Jul. 23, 2012

(87) PCT Pub. No.: WO2011/094104

PCT Pub. Date: Aug. 4, 2011

(65) Prior Publication Data

US 2012/0291279 A1 Nov. 22, 2012

Related U.S. Application Data

(60) Provisional application No. 61/298,336, filed on Jan. 26, 2010.

(51) Int. Cl.
*B25B 27/00* (2006.01)

(52) U.S. Cl.
USPC ..... 81/484; 81/488

(58) Field of Classification Search
USPC ..... 81/484, 488, DIG. 5, 124.2
See application file for complete search history.

(56) References Cited

U.S. PATENT DOCUMENTS

| | | | | |
|---|---|---|---|---|
| 3,857,086 | A | 12/1974 | Mooney et al. | |
| 3,906,917 | A | 9/1975 | Lorti | |
| 4,011,851 | A | 3/1977 | Beutler | |
| 4,153,030 | A | 5/1979 | Power et al. | |
| 4,177,781 | A | 12/1979 | Marchelletta et al. | |
| 4,363,297 | A * | 12/1982 | Naito | 123/406.75 |
| 5,105,155 | A | 4/1992 | Boaze, Sr. | |
| 5,425,168 | A | 6/1995 | Bumbaca et al. | |
| 5,431,134 | A | 7/1995 | Budde et al. | |
| 5,513,617 | A | 5/1996 | Bass | |
| 7,677,139 | B2 * | 3/2010 | Salanda | 81/124.2 |

FOREIGN PATENT DOCUMENTS

FR 2633980 A * 1/1990

* cited by examiner

*Primary Examiner* — Hadi Shakeri
(74) *Attorney, Agent, or Firm* — Richard C. Litman

(57) ABSTRACT

The internal combustion engine ignition timing tool (10) installs removably atop the distributor housing (D) after removal of the distributor cap (C), and enables the mechanic to set timing accurately without need of additional equipment. In one embodiment, the tool has a single collar (12), while the other embodiment has an inner collar adjustably rotating within an outer collar. Each has a rotor tip clearance notch (22). The engine is turned to align the conventional external timing marks, and the distributor (D) is turned opposite the normal rotational direction of the engine to push the leading face (24) of the clearance notch (22) against the rotor tip, thus removing all gear lash and slack from the system.

6 Claims, 6 Drawing Sheets

INTERNAL COMBUSTION ENGINE IGNITION TIMING TOOL

CROSS-REFERENCE TO RELATED APPLICATION

This application is a 371 of PCT/US2011/021728, filed Jan. 19, 2011, which claims the benefit of U.S. Provisional Patent Application Ser. No. 61/298,336, filed Jan. 26, 2010.

TECHNICAL FIELD

The present invention relates generally to mechanical tools and the like, and more specifically to an internal combustion engine ignition timing tool that enables the ignition timing of an internal combustion engine to be set more quickly and accurately upon initial installation of the distributor prior to starting the engine and without the aid of a conventional timing light.

BACKGROUND ART

Although many spark ignition internal combustion engines now have essentially fixed initial ignition timing by using a crankshaft position sensor or the like, a large number of such engines still rely upon an ignition timing system wherein a rotor rotates within a distributor to distribute the spark impulse to the individual cylinders as the rotor revolves within the distributor. Such systems are mandatory in certain classes of racing vehicles. This basic principle is the same for mechanical points-type distributors in which a cam lobe(s) on the distributor shaft periodically opens and closes the breaker points, and for so-called "breakerless" systems in which magnetism or light (visible or invisible spectrum) is used as the timing signal. The same basic timing principle is used with magneto ignition systems. The primary difference between the conventional distributor system and the magneto system is that the magneto also serves as an electrical generator to produce the electrical energy required for the ignition system.

Basic distributor and magneto ignition systems universally rely upon a distributor shaft that is geared to a rotary component of the engine, generally a camshaft or crankshaft. The distributor rotor is affixed to the end of the distributor shaft within the distributor housing. Due to the tolerances and gear lash inherent in such a mechanical system, as well as point wear in a mechanical point system, the distributor or magneto is always provided with some means for adjusting the timing of the ignition pulse to each cylinder. This is generally accomplished by allowing the distributor or magneto to be rotated slightly in its installation and locked into place when the timing has been set accurately. In the case of a magneto ignition system, this is known as "external timing," as opposed to internal magneto timing in which the timing of the rotary components for maximum efficiency in generating the required electrical energy ("e-gap") is accomplished.

There are essentially two methods of setting the ignition timing with such an ignition system: The timing may be set with the engine operating (running), or with the engine stationary (shut down). In the case of an operating engine, the gear lash and play in the system is automatically taken up due to engine rotation driving the distributor or magneto. The mechanic may set the timing by using a timing light temporarily connected to the ignition lead to the designated number one cylinder, rotating the distributor or magneto to set the timing as required, and securing the distributor or magneto in place by means of the conventional clamp or other means provided.

However, in the case of a stationary engine, the mechanic must take into account any play and gear lash in the distributor or magneto drive system. This is particularly true in situations where the distributor or magneto has been removed from the engine, e.g., for engine rebuild or other major work, ignition system overhaul or replacement, etc. In such cases, the mechanic turns the engine over to position the timing marks so that the number one piston is at or near top dead center on its compression stroke, and adjusts the distributor or magneto to an initial position that appears to be at least close to the desired ideal timing. However, the mechanic must still set the timing using a timing light or audible signal, the timing light or signal being activated when the points (or other electromagnetic signal) first open. This method of timing using a timing light when the engine is stationary will still not provide the required degree of accuracy due to the gear lash and play in the distributor drive system. A knowledgeable mechanic will always turn the engine slightly in a direction opposite its normal direction of rotation, and then rotate the engine in the operating direction to the desired external timing mark on the crankshaft pulley or damper in order to remove gear lash and play when setting timing on a stationary engine. Checking timing after this procedure may reveal that the timing is still not optimal, and the process must be repeated while the engine is operating. Obviously, this is a tedious and time-consuming task.

Thus, an internal combustion engine ignition timing tool solving the aforementioned problems is desired.

DISCLOSURE OF INVENTION

The internal combustion engine ignition timing tool is a collar that is removably secured to the top of the distributor (or magneto) housing after the distributor cap is removed. The collar is indexed to the top of the distributor by means of a notch and key or other system used to index the distributor cap to the distributor. The collar has an upper portion that extends inwardly over the upper edge of the distributor housing and interferes with rotation of the distributor rotor. However, a rotor tip clearance notch is provided in one side of the upper portion, the rotor tip being positioned within this notch when the timing tool is properly installed on the distributor. The timing tool is configured for use with various makes and models of distributors and magnetos, e.g., appropriate diameter and attachment means, orientation of the rotor tip clearance notch, etc.

The timing tool is used by initially turning the engine over in the direction of operation to align the external timing marks on the engine crankshaft pulley or damper with the corresponding marks on the engine case or block. The timing tool is then installed on the top of the distributor or magneto after removal of the distributor cap or magneto cap. The timing tool is immovably affixed to the distributor or magneto housing the same means used to attach the cap, e.g., bolts, clips, etc., the rotor being positioned within the rotor tip clearance notch. The distributor or magneto may be rotated as required to position the rotor within the clearance notch as the timing tool is installed. The distributor or magneto is then rotated opposite the direction of normal rotation until the leading face of the rotor tip clearance notch contacts the tip of the rotor and pushes the rotor rearward (opposite its normal direction of rotation) until all gear lash and play have been removed from the rotor drive system. The opposite trailing face of the clearance notch is preferably beveled to show that the leading face is the correct rotor tip contact face, as some engine distributors rotate clockwise and some rotate counterclockwise. The distributor hold-down clamp may then be tightened to lock the distributor in place, assuring that the timing is set accurately with no play or backlash in the system. The internal combustion engine ignition timing tool is then removed from the distributor housing and the distributor cap is replaced, the distributor system being optimally timed and operable without need for a timing light or other means of setting and/or verifying the ignition timing.

In an alternative embodiment, the tool comprises an outer portion that is removably affixed to the distributor housing, and an inner portion that may be rotated relative to the outer portion. The inner portion includes the rotor tip clearance notch. This embodiment is used by first immovably affixing the outer portion to the top of the distributor housing, as in the case of the first embodiment. The inner portion is rotated relative to the outer portion to position the clearance notch as required to clear the rotor. The inner portion may be rotated so that the rotor tip contact face of the contact notch pushes the rotor rearward against its normal direction of rotation to remove all play and lash from the distributor and rotor drive system to a predetermined specific timing degree. The inner portion of the tool is then locked in place relative to the outer portion, and the distributor is clamped in place, as described for the single piece tool. The tool may then be removed from the distributor, and the cap is reinstalled to complete the distributor timing process.

In this embodiment, since the inner portion of the tool is adjustable relative to the outer portion, the two-part tool is not limited to use with only one specific distributor and engine configuration. In fact, the rotor tip clearance notch may be positioned anywhere through 360° of rotation relative to the outer portion, thus allowing the mechanic to set the timing using any of the engine cylinders or ignition leads in the event that a cylinder other than the number-one cylinder is referenced (or if the number one wire is relocated on the cap for some reason) for setting the timing. The inner portion of the collar is also symmetrical relative to its two opposite ends, thus allowing the inner portion to be inverted. This swaps the two faces of the rotor tip clearance notch, thus allowing the tool to be used with any engine, regardless of the direction of rotation of the distributor rotor.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

The internal combustion engine ignition timing tool enables even the most novice mechanic to install a distributor or magneto and set the ignition timing accurately on a stationary (non-operating) engine without the need for further checking or verification of the timing by means of using a conventional timing light on the operating engine unless desired by the mechanic as further confirmation. The ignition timing tool serves as a stop for the rotor in the distributor or magneto. Rotation of the distributor or magneto with the timing tool installed thereon opposite the direction of normal operation urges the rotor back to remove slack and gear lash in the system, thereby permitting the timing to be set accurately with no further steps required on the part of the mechanic.

Figure 1:
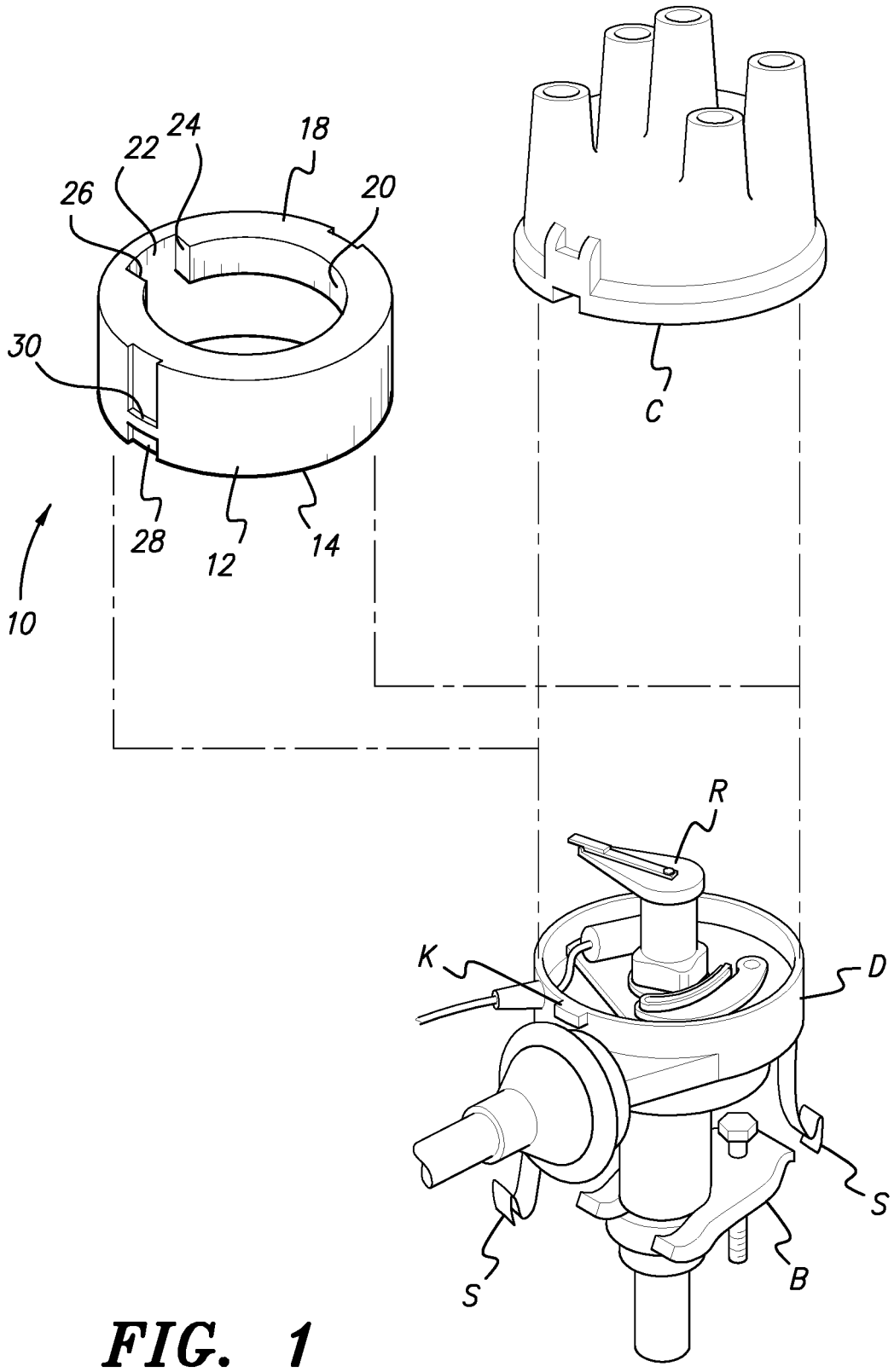
FIG. 1 is an exploded perspective view of a conventional distributor housing with the cap removed, showing the removable installation thereon of a first embodiment of an internal combustion engine ignition timing tool according to the present invention.
Figure 2:
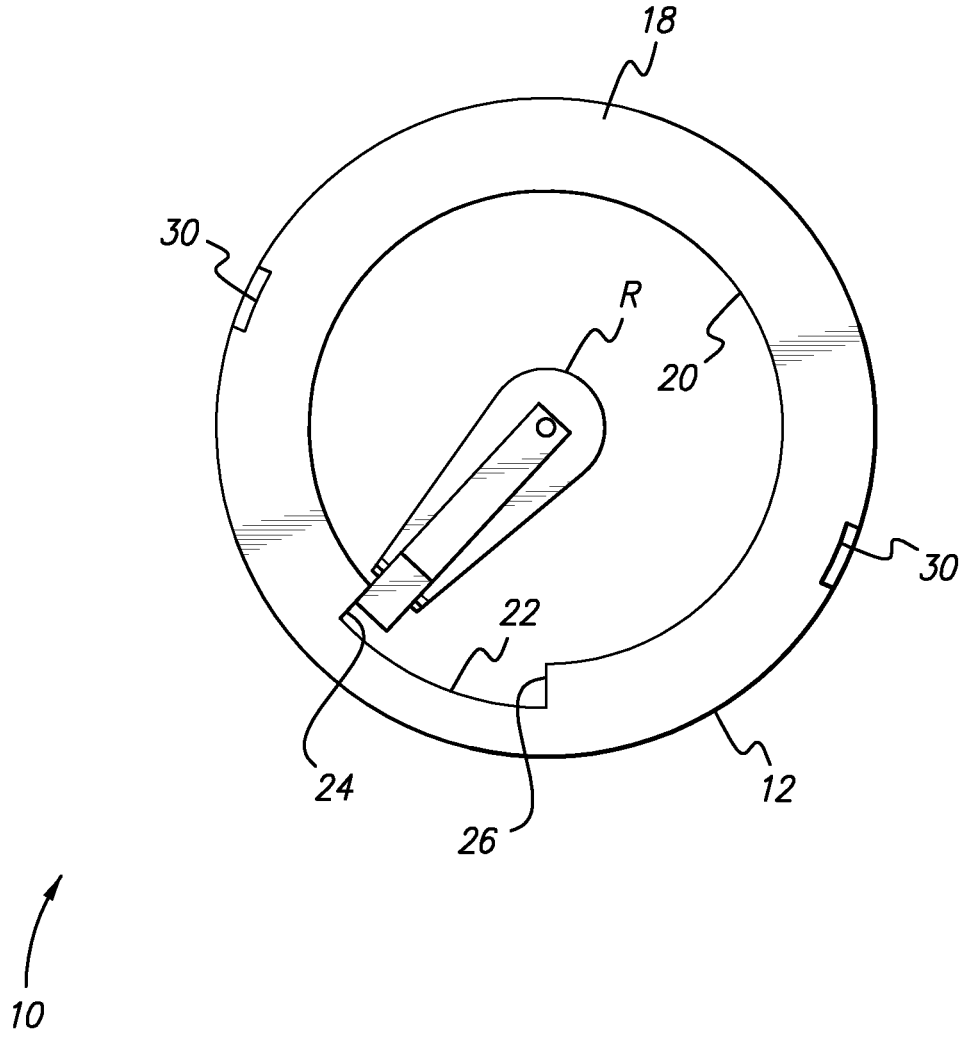
FIG. 2 is an environmental top plan view of the ignition timing tool of FIG. 1 shown installed atop the distributor housing, and particularly showing the rotor tip clearance notch relative to the distributor rotor.
Figure 3:
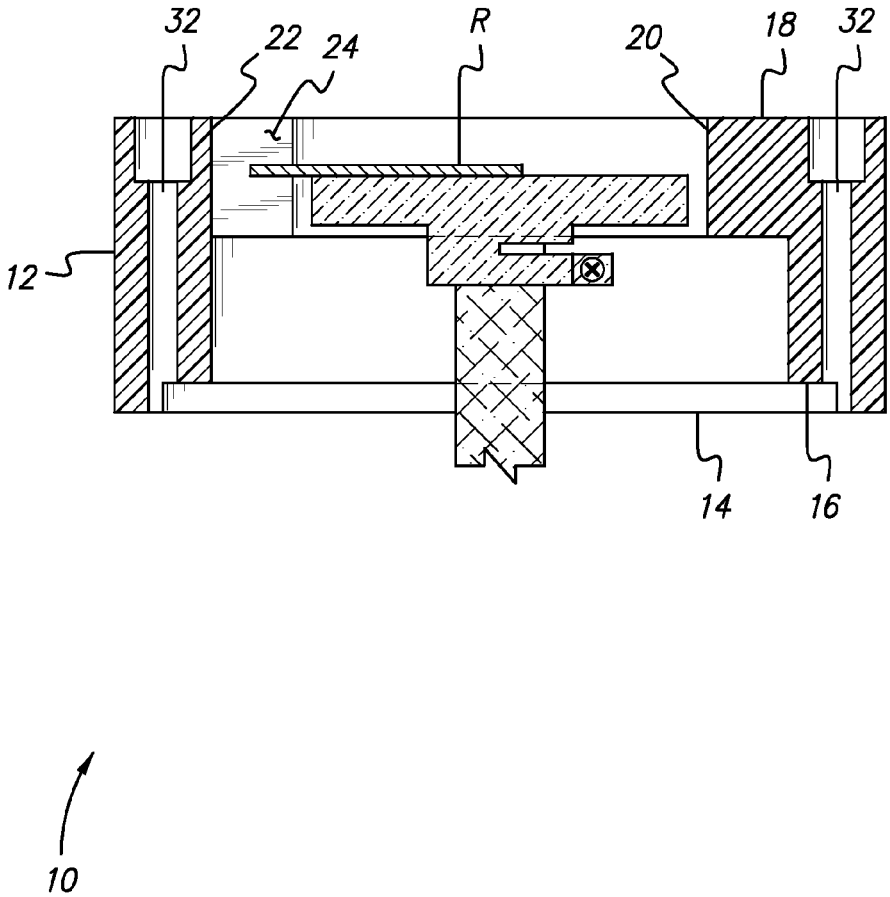
FIG. 3 is a side elevation view in section of the ignition timing tool installation of FIG. 2, further showing the orientation of the distributor rotor and the upper portion of the rotor shaft within the tool.

FIGS. 1 through 3 of the drawings illustrate a first embodiment of the ignition timing tool 10, comprising an open, one-piece collar 12 that is removably installed atop the distributor housing D. The bottom 14 of the collar 12 has a distributor housing seat 16 (shown in FIG. 3) formed therearound that fits precisely over the rim of the distributor housing D in the manner of the fit of the conventional distributor cap C atop the distributor housing D. The top 18 of the tool 10 has an inwardly extending flange 20 that serves as a stop for the distal tip of the distributor rotor R, limiting the arcuate motion of the rotor R when the timing tool 10 is installed on the distributor D. The rotor stop flange 20 includes a rotor tip clearance notch 22 therein. The notch 22 has a first face 24 and an opposite second face 26.

The ignition timing tool 10 is used substantially as illustrated in FIGS. 1 through 3. Initially, the engine crankshaft is turned to position or align the conventional timing mark on the crankshaft pulley or damper with the stationary mark on the engine block or case, as required. The distributor (or magneto) and its drive shaft are then installed in the appropriate port or receptacle of the engine and aligned at least approximately with the desired optimal position, if this step has not been accomplished previously. The distributor base hold-down bracket B is not tightened at this point in order to allow the distributor housing D to be rotated for adjustment, as described below. At this point the distributor cap C is removed, if not done previously, and the ignition timing tool 10 is installed atop the distributor housing D in place of the cap C.

The timing tool 10 is oriented properly atop the distributor housing D by the conventional key K extending from the upper edge of the distributor housing D that is used to align the distributor cap C properly atop the distributor housing D. The timing tool 10 has a corresponding notch 28 along its bottom periphery that fits over the distributor housing key K to hold the tool 10 in the proper orientation relative to the distributor housing D. The ignition timing tool 10 may make use of the conventional attachments used to secure the cap C to the distributor housing D. In the example of FIGS. 1 and 2, the distributor housing D has two opposed spring clips S extending from opposite sides thereof, which engage corresponding lands formed on the distributor cap C. Similar lands 30 may be provided along the sides of the ignition timing tool 10 so that the spring clips S clip onto the lands 30 of the tool 10 to secure the tool 10 in place atop the distributor housing D. Alternatively, some distributors conventionally secure their caps in place by means of threaded fasteners. The ignition timing tool 10 of FIG. 3 may include passages 32 for such fasteners, enabling the timing tool 10 of FIG. 3 to be bolted atop a corresponding distributor cap.

When the ignition timing tool 10 has been installed atop the distributor housing D, as described above and illustrated in FIGS. 2 and 3, the tool 10 is rotated in a direction opposite the normal direction of rotation of the rotor R during engine operation. As the timing tool 10 is immovably affixed relative to the distributor housing D and the distributor housing D is not yet secured to the engine case or block, the distributor housing D will rotate in unison with the timing tool 10. However, the distributor rotor R is geared to the distributor drive train that is driven by the engine, and as the engine is not running, the rotor R will remain stationary with the exception of some movement due to slack and gear lash in the distributor drive train.

The ignition timing tool 10 and the distributor housing D are rotated until the leading one of the two faces 24 or 26 of the rotor tip clearance notch 22, i.e., the face that is in first position in the direction of rotation of the rotor R during engine operation, contacts the tip of the rotor R. In the example of FIGS. 2 and 3, the distributor rotor R rotates clockwise during normal engine operation. Thus, the ignition timing tool 10 is rotated counterclockwise until the first face 24 of the rotor tip clearance notch 22 contacts the tip of the rotor R. The timing tool 10 is rotated as far in a counterclockwise direction as possible, pushing the rotor R counterclockwise until all slack and gear lash in the distributor shaft drive gearing is taken up. This will place the rotor R in essentially the same position of rotation relative to the distributor drive train and engine crankshaft rotation as will be the case when the engine is running, as the drag of various components in the ignition system will normally take up any gear lash and play in the system during engine operation. Thus, the corresponding position of the distributor housing D will be optimal for the correct ignition timing when the above-described procedure is carried out using the ignition timing tool 10.

When the rotational position of the distributor housing D has been set as described above, all that remains is to lock the distributor housing D immovably in place by tightening the hold-down bracket B, remove the ignition timing tool 10 from the distributor housing D, and replace the distributor cap C atop the distributor housing D. The ignition system of the engine is now properly timed and ready for operation without the need for further checking and adjustment with a timing light while the engine is running, any need for other tools, equipment, and/or procedures.

Figure 4:
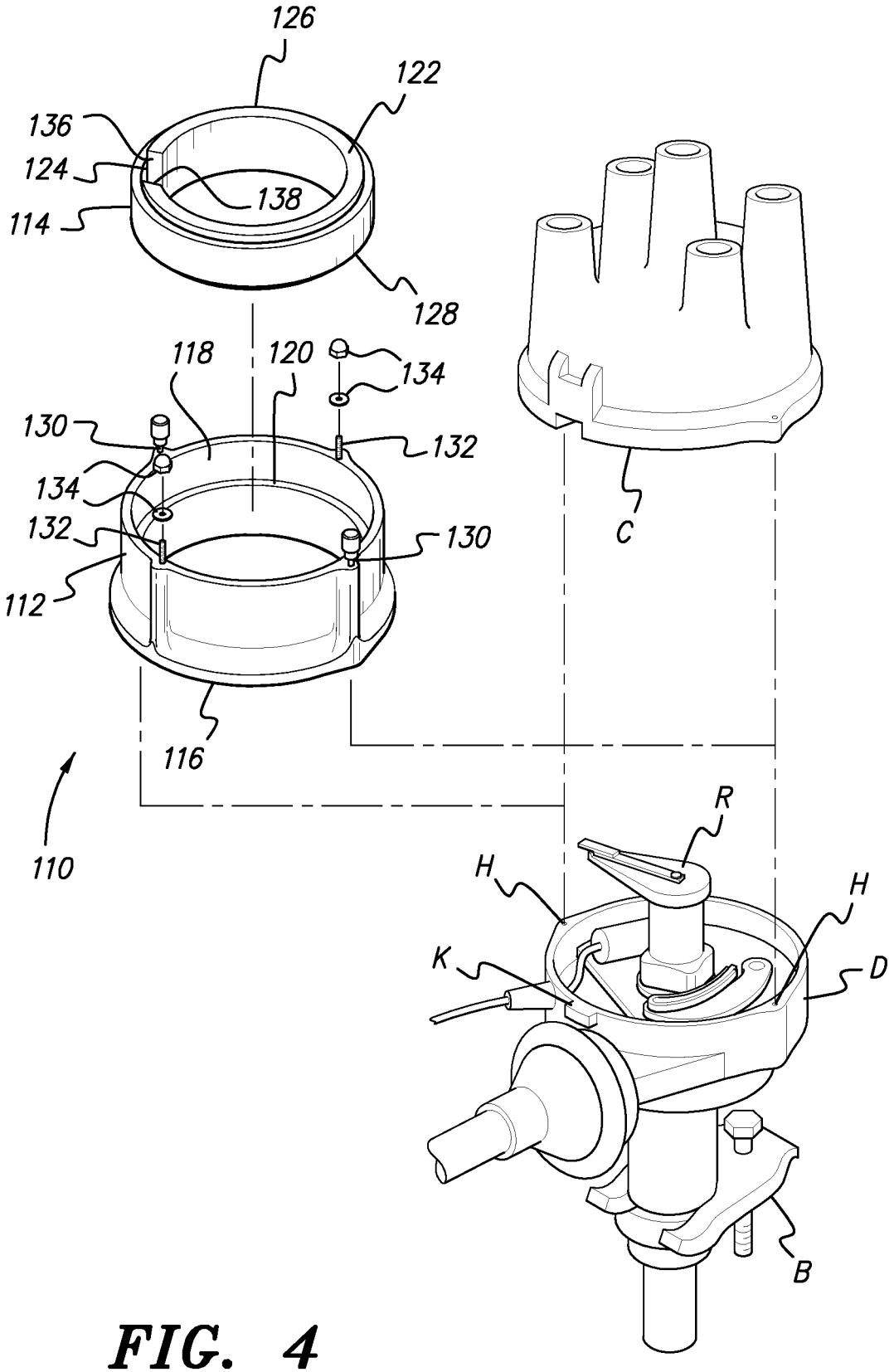
FIG. 4 is an exploded perspective view of a second embodiment of an internal combustion engine ignition timing tool according to the present invention, shown in relation to a conventional distributor with the cap removed.
Figure 5:
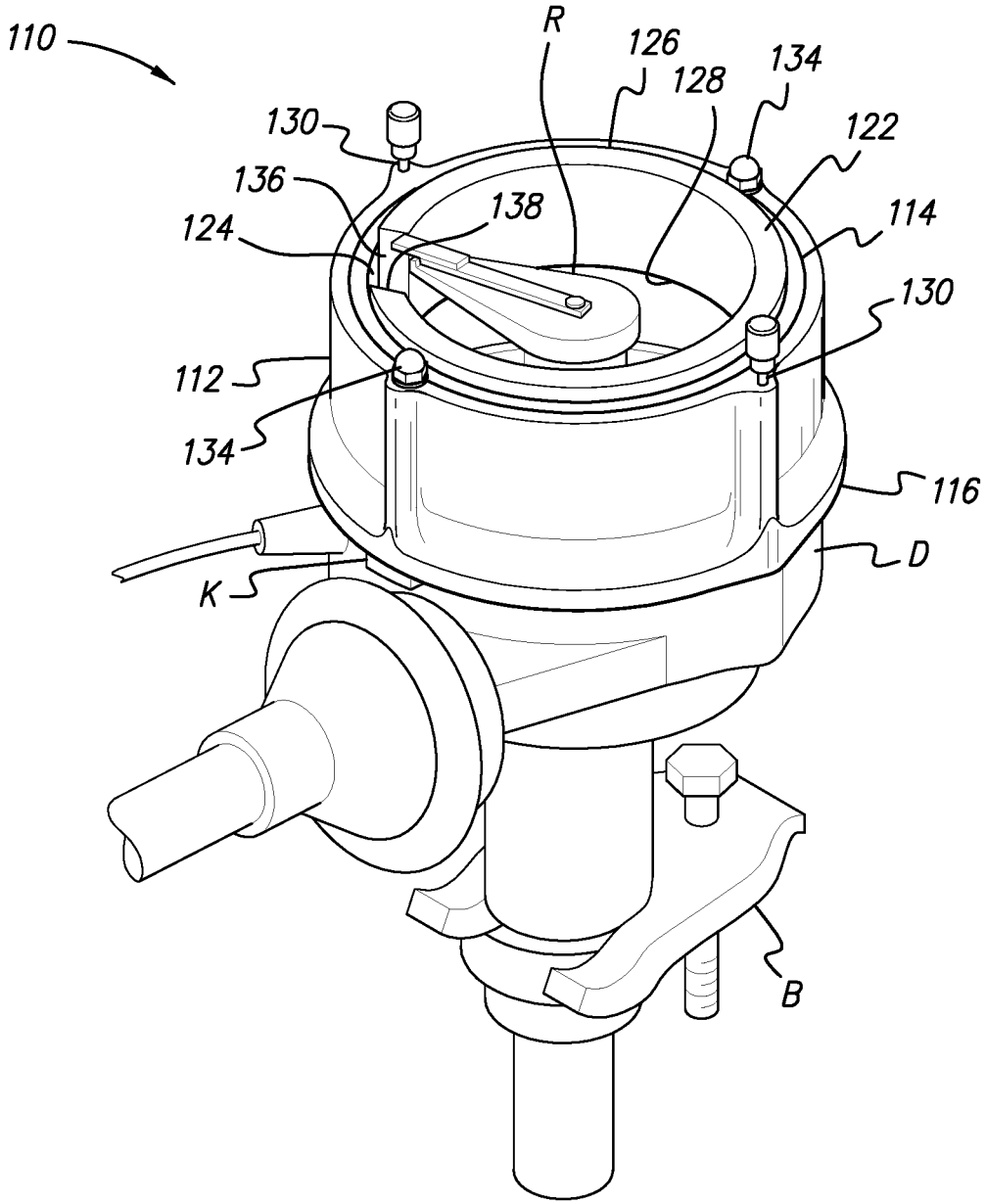
FIG. 5 is an environmental perspective view of the ignition timing tool of FIG. 4 installed atop a conventional distributor housing, and particularly showing the distributor rotor positioned within the adjustably positionable rotor tip clearance notch of the tool.
Figure 6:
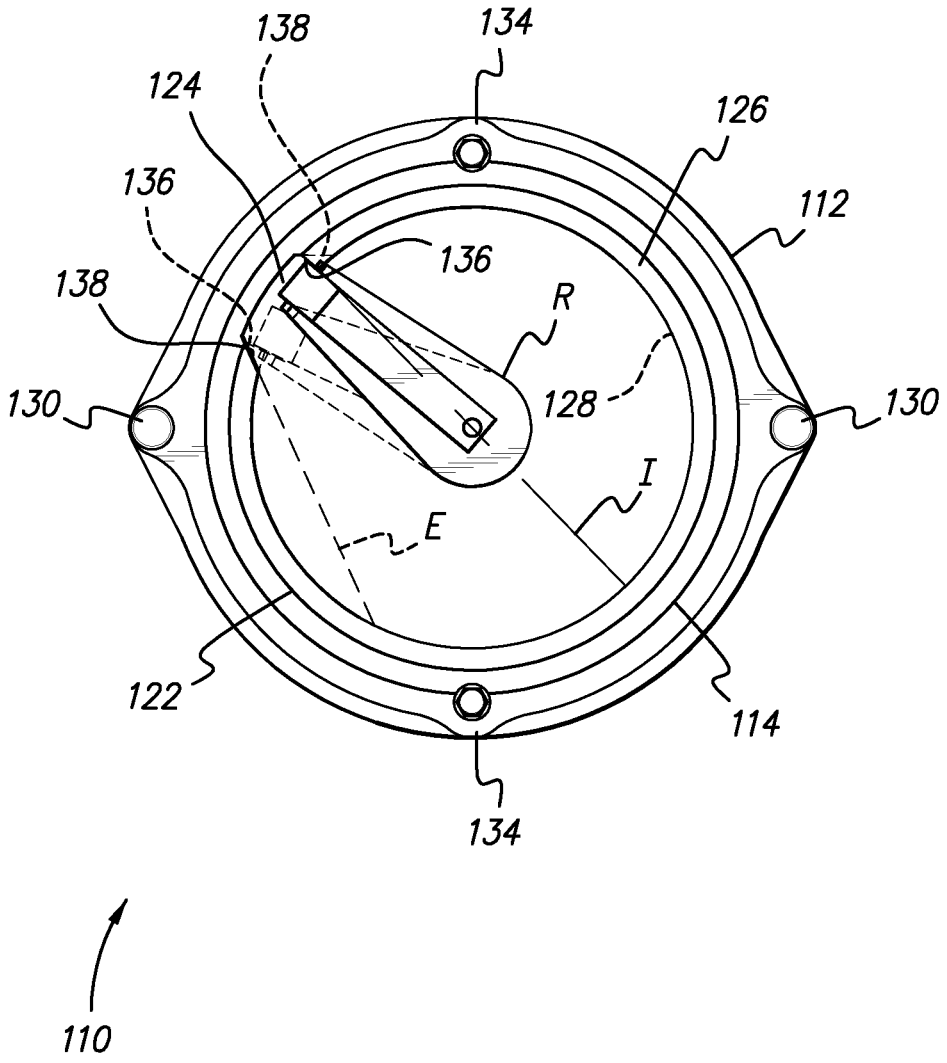
FIG. 6 is an environmental top plan view of the ignition timing tool of FIGS. 4 and 5, shown with the inner portion in upright and inverted orientations, the inverted orientation being shown in broken lines.

FIGS. 4 through 6 illustrate an alternative embodiment of the internal combustion engine ignition timing tool, designated as ignition timing tool, timing tool, or tool 110. The timing tool 110 is a two-piece assembly comprising an open outer collar portion 112 and an open inner collar portion 114. The outer collar portion 112 includes a bottom 116 having a seat adapted to fit the upper rim of the distributor housing D that is substantially the same as the seat 16 formed about the bottom 14 of the timing tool 10 shown in FIG. 3. The inner wall 118 of the outer collar portion 112 includes a circumferential stop ring 120 disposed about the lower portion thereof. The stop ring 120 has a slightly smaller internal diameter than the remainder of the inner wall 118. The stop ring 120 serves to limit the insertion of the inner portion 114 of the tool 110 into the outer portion 112 when the two portions are assembled with one another.

The inner collar portion 114 of the tool 110 comprises a circumferentially continuous and unbroken ring, and has a rotor stop flange 122 having a rotor tip clearance notch 124 extending inwardly therein. The inner collar portion 114 has an outer diameter that fits closely within the inner wall 118 of the outer collar portion 112, the inner collar portion 114 seating upon the stop ring 120 of the outer collar portion 112 when the two components 112 and 114 are assembled with one another. The inner collar portion 114 is symmetrical relative to its mutually opposed first and second ends 126 and 128, i.e., each end is a mirror image of the other. This allows the inner collar portion 114 to be inverted in its placement within the outer collar portion 112, which can provide greater versatility for the two-part tool 110, as discussed further below.

The two-part ignition timing tool 110 is used generally in the manner described further above for using the single component tool 10. After the engine crankshaft has been properly positioned to fire the number-one cylinder and the distributor (or magneto) has been installed and approximately oriented, the distributor cap C is removed (if not done previously) and the timing tool 110 is installed atop the distributor housing D. The outer collar component 112 includes a notch substantially the same as the notch 28 of the ignition tool 10 of FIGS. 1 through 3 to mate with the key K of the distributor housing D. The outer collar portion 112 uses conventional means for attachment to the distributor base D. These conventional means may comprise the spring clips S illustrated in FIGS. 1 and 2, or threaded fasteners 130 that thread into mating holes H in the distributor housing D, as shown in FIGS. 4 through 6, according to the specific structure of the distributor.

When the ignition timing tool 110 has been installed atop the distributor housing D, as described above and illustrated in FIGS. 3 through 6, the inner collar component or portion 114 of the tool 110 is placed within the outer collar portion or component 112, and its rotor tip clearance notch 124 is aligned with the tip of the rotor R, if this has not been done previously. The ability to rotate the inner collar portion 114 freely relative to the outer collar portion 112 provides much greater versatility for the tool 110, allowing it to be used with a wide variety of distributors D so long as those distributors have a housing compatible with the lower collar portion 112. For example, the rotor R may be "clocked" at a different location to fire the number one cylinder in different distributors, or a different cylinder may be used as the reference cylinder for timing. When the inner collar portion 114 has been positioned and oriented relative to the distributor rotor R and the outer collar portion 112, it is locked or secured immovably to the outer collar portion 112. This may be accomplished by any of several different means. The means illustrated in FIGS. 4 through 6 comprises a pair of short, threaded studs 132 permanently secured in the upper edge or lip of the outer collar component 112, and a nut and washer assembly 134 removably attached to each stud 132. The washers have sufficiently large diameters as to overlap the underlying edge of the inner collar portion 114 just outboard of the rotor stop flange 122 when the inner collar 114 is installed within the outer collar 112. When the nuts 134 are loosened slightly, the inner collar portion 114 is free to rotate within the outer collar portion 112. However, when the nuts 134 are tightened, their washers bear down on the edge of the inner collar portion 114 to grip the inner collar 114 and prevent its rotation relative to the outer collar 112.

When the above installation has been accomplished, the assembly comprising the inner collar portion 114, outer collar portion 112, and distributor housing D are rotated in a direction opposite the normal direction of rotation of the rotor R during engine operation, as in the use and operation of the timing tool 10 of FIGS. 1 through 3. As the timing tool 110 (outer and inner portions 112 and 114) is immovably affixed relative to the distributor housing D and the distributor housing D is not yet secured to the engine case or block, the distributor housing D will rotate in unison with the timing tool 110. However, the distributor rotor R is geared to the distributor drive train that is driven by the engine, and as the engine is not running, the rotor R will remain stationary, with the exception of some movement due to slack and gear lash in the distributor drive train.

The ignition timing tool 110 and the distributor housing D are rotated until the leading one of either the first face 136 or the second face 138 of the rotor tip clearance notch 124, i.e., the face that is in first position in the direction of rotation of the rotor R during engine operation, contacts the tip of the rotor R. In the example of FIG. 5, the distributor rotor R rotates clockwise during normal engine operation. Thus, the ignition timing tool 110 is rotated counterclockwise until the first face 136 of the rotor tip clearance notch 124 contacts the tip of the rotor R. The timing tool 110 is rotated as far in a counterclockwise direction as possible, pushing the rotor R counterclockwise until all slack and gear lash in the distributor shaft drive gearing is taken up. This will place the rotor R in substantially the same position of rotation relative to the distributor drive train and engine crankshaft rotation as will be the case when the engine is running, as the drag of various components in the ignition system will normally take up any gear lash and play in the system during engine operation. Thus, the corresponding position of the distributor housing D will be optimal for the correct ignition timing when the above-described procedure is carried out using the ignition timing tool 110.

When the rotational position of the distributor housing D has been set, as described above, all that remains is to lock the distributor housing D immovably in place by tightening the hold-down bracket B, remove the ignition timing tool 110 (both components 112 and 114) from the distributor housing D, and replace the distributor cap C atop the distributor housing D. The ignition system of the engine is now property timed and ready for operation without the need for further checking and adjustment with a timing light while the engine is running, any need for other tools, equipment, and/or procedures.

It will be seen in FIGS. 4 and 6 of the drawings that the two end faces 136 and 138 define different angles relative to the rotor tip clearance notch 124 of the inner collar portion 114. The first face 136 is substantially coplanar with the diameter I of the inner collar 114, while the second face 138 is coplanar with a secant E of the inner collar 114, the secant E not passing through the center of the inner collar 114. The angle between the plane of the second face 138 relative to the plane of the first face 136 is equal to the angle between the diameter I and the secant E, and may be adjusted as desired. This angular offset of the second face 138 relative to the diameter I of the inner collar 114 serves as a visual aid to identify the proper direction of rotation of the timing tool 110 when installed on the distributor housing D.

The inner collar portion 114 is symmetrical relative to its two ends 126 and 128, as noted further above. In FIG. 6, the first face 136 of the rotor tip clearance notch 124 is positioned clockwise from the second face 138, as shown in solid lines. This is the orientation of the timing tool 110 as it would be used to set the timing of a distributor where the rotor R rotates in a clockwise direction. It will be seen in FIG. 6 that the timing tool 110 has been rotated in a counterclockwise direction so that the first face 136 is in contact with the tip of the rotor R, to urge the rotor R counterclockwise to take up all gear lash and play in the system.

Conversely, the inner collar portion 114 may be inverted to position the first face 136 counterclockwise relative to the second face 138, with this relationship being shown in broken lines in FIG. 6. This is the orientation that would be used to set the timing in a distributor in which the rotor rotates in a counterclockwise direction, such a rotor being shown in broken lines in FIG. 6. In this situation, the timing tool 110 would be rotated clockwise, with the first face 136 of the rotor tip clearance notch 124 contacting the tip of the rotor R and pushing it clockwise to remove all gear lash and play in the system.

In conclusion, the internal combustion engine ignition timing tool greatly facilitates the setting of ignition timing in such an engine, eliminating previously required tedious and likely repetitive steps in the process. The tool may be applied to a wide variety of ignition systems, including distributors and magnetos in automobiles and other land vehicles, aircraft, boats, and stationary powerplants such as generators and the like. The device, in either of its embodiments, may be constructed of any of several solid or rigid materials, including various metals (aluminum, various grades of steel, etc.), any of a wide number of different plastics, and/or even composites, such as glass or carbon fiber in an epoxy or polyester resin matrix. The first embodiment of FIGS. 1 through 3 is somewhat limited in its versatility due to its lack of adjustability, but will serve the home mechanic well for use in tuning a specific engine. The second embodiment of FIGS. 4 through 6, with its wide adjustability and versatility, will find greater favor among professional mechanics who have need for a tool that may be used on a wide variety of different distributor and magneto ignition systems, the limiting factor being only the diameter of the distributor or magneto unit and the cap attachment means that is also used to attach the tool to the distributor or magneto. Accordingly, a small number of such ignition timing tools will cover a wide variety of different ignition systems and will greatly assist the professional mechanic in his work.

It is to be understood that the present invention is not limited to the embodiments described above, but encompasses any and all embodiments within the scope of the following claims.

I claim:

1. An ignition timing tool for use with internal combustion engines, the tool comprising:

an open outer collar portion having a bottom defining a distributor housing seat disposed therearound, a top opposite the bottom, an inner wall, and a circumferential stop ring disposed about the inner wall;

an open inner collar portion having an inwardly disposed rotor stop flange, the flange having a rotor tip clearance notch defined therein, the open inner collar portion having a first end and a second end opposite the first end, the open inner collar portion removably and rotationally seating within the inner wall of the outer collar portion and resting upon the stop ring thereof when the inner collar portion is installed within the outer collar portion; and means for temporarily locking the inner collar portion positionally relative to the outer collar portion.

2. The ignition timing tool according to claim 1, wherein the inner collar portion is symmetrically configured relative to the first end and the second end thereof.

3. The ignition timing tool according to claim 1 wherein the inner collar portion has a diameter, the first face of the rotor tip clearance notch being coplanar with the diameter of the inner collar portion, the second face of the rotor tip clearance notch being coplanar with a secant of the inner collar portion.

4. The ignition timing tool according to claim 1, further including distributor housing attachment means selected from the group consisting of clips and threaded fasteners.

5. The ignition timing tool according to claim 1, wherein the outer collar portion and the inner collar portion are formed of rigid materials selected from the group consisting of metal, plastic, and composite materials.

6. A method of timing the ignition of an internal combustion engine, the engine having a distributor including a distributor cap and rotor, the engine further having timing marks thereon, the method comprising the steps of:

(a) providing an ignition timing tool comprising an open outer collar portion having a bottom, an inner wall, and a circumferential stop ring disposed about the inner wall, and a separate open inner collar portion, the rotor stop flange extending inwardly therefrom;

(b) removing the distributor cap from the distributor;

(c) aligning the timing marks on the engine;

(d) rotating the distributor to a position corresponding with ignition for a predetermined engine cylinder;

(e) installing the outer collar portion on the distributor so that the distributor housing seat rests atop the distributor;

(f) positioning the inner collar portion within the outer collar portion so that the tip of the rotor extends into the rotor tip clearance notch of the inner collar portion;

(g) temporarily securing the inner collar portion immovably to the outer collar portion; and (h) rotating the inner collar portion opposite the direction of normal rotor rotation until one face of the rotor tip clearance notch contacts the tip of the rotor and urges the rotor opposite its direction of normal rotor rotation on order to remove gear lash and play from the distributor system;

(i) securing the distributor immovably to the engine;

(j) removing the collar from the distributor; and (k) reinstalling the distributor cap on the distributor.

* * * * *